US007574756B2

(12) United States Patent
Tran

(10) Patent No.: US 7,574,756 B2
(45) Date of Patent: Aug. 18, 2009

(54) RE-CIRCULATING MULTIPLE DIRECTIONAL WHIRLPOOL JET

(76) Inventor: Vu Tran, 5517 Enfield Dr., Richardson, TX (US) 75082

( * ) Notice: Subject to any disclaimer, the term of this patent is extended or adjusted under 35 U.S.C. 154(b) by 724 days.

(21) Appl. No.: 11/224,645

(22) Filed: Sep. 12, 2005

(65) Prior Publication Data

US 2006/0064813 A1 Mar. 30, 2006

Related U.S. Application Data

(60) Provisional application No. 60/613,042, filed on Sep. 24, 2004.

(51) Int. Cl.
*A47K 33/02* (2006.01)

(52) U.S. Cl. ..... 4/541.6

(58) Field of Classification Search ..... 4/492, 4/541.3, 541.4, 541.6, 904
See application file for complete search history.

(56) References Cited

U.S. PATENT DOCUMENTS 4,256,277 A 3/1981 Embree
4,414,695 A 11/1983 Hart
5,063,620 A 11/1991 Mersmann
5,414,878 A 5/1995 Booth
5,920,925 A 7/1999 Dongo
6,065,161 A * 5/2000 Mateina et al. ..... 4/541.6
7,108,202 B1 * 9/2006 Chang ..... 4/541.6 X

* cited by examiner

*Primary Examiner*—Robert M Fetsuga
(74) *Attorney, Agent, or Firm*—James Ray & Assoc.

(57) ABSTRACT

An apparatus for re-circulating a fluid contained within a hydrotherapeutic receptacle without the need for piping to a motor. The apparatus includes a jet housing having a portion thereof engageable with such receptacle. A nozzle device is located at one end of the housing to provide an entrance for such fluid to be suctioned into the housing and an exit for such suctioned fluid to be expelled from the housing. A control device is located adjacent the nozzle device to control fluid flow of such fluid suctioned into the housing and fluid flow of such fluid expelled from the housing. An expulsion unit is located adjacent the control device to expel such fluid from the housing back into such receptacle. A power source is connected to the expulsion unit to enable it to expel such fluid from the housing at a predetermined pressure into such receptacle at a predetermined rate.

18 Claims, 4 Drawing Sheets

RE-CIRCULATING MULTIPLE DIRECTIONAL WHIRLPOOL JET

CROSS REFERENCE TO RELATED APPLICATION

This application is closely related to and claims benefit from U.S. Provisional Patent Application Ser. No. 60/613,042 filed on Sep. 24, 2004.

FIELD OF THE INVENTION

The present invention relates, in general, to whirlpool jet units used to re-circulate a fluid contained within hydrotherapeutic receptacles such as whirlpools, spas, hot tubs or bathtubs and, more particularly, the invention relates to a whirlpool jet unit for re-circulating a fluid contained within a hydrotherapeutic receptacle without the need for excessive piping to either of a motor or a water pump system used to re-circulate the fluid.

BACKGROUND OF THE INVENTION

Whirlpool jet units used in hydrotherapeutic receptacles to relax and soothe muscles and joints in people have been in existence for many years. The jet stream is directed into the receptacle through fixed nozzles positioned in the side walls of the receptacle that receive water under pressure through a piping system from a water pump.

One problem with these units is that the jet steams must generally travel a long distance to reach an occupant on the other side of the receptacle, thus creating the need for a large pump and pipes to create the desired effect. These large components, obviously, increase the cost and complexity of the units.

Another problem that arises is cleaning and servicing the various jet components when positioned in the side walls of the receptacle. Many of the jet nozzles are complex and not easily accessible for cleaning out the various detrimental deposits from the water, and possibly other therapeutic solvents mixed with the water, that can clog the jet nozzles.

Thus, a need exists for a less complex whirlpool jet unit that can be easily installed in such hydrotherapeutic receptacles and, also, once installed, can be easily disassembled for cleaning and maintenance.

SUMMARY OF THE INVENTION

The present invention provides an apparatus for re-circulating a fluid contained within a hydrotherapeutic receptacle, such as a whirlpool, a spa, a hot tub or a bathtub, without the need for piping to either of a motor or a water pump system. The apparatus includes at least one jet housing having a portion thereof engageable with such hydrotherapeutic receptacle. A nozzle means is located at one end of the jet housing to provide an entrance for a predetermined amount of fluid to be suctioned into the jet housing and an exit for a predetermined amount of suctioned fluid to be expelled from the jet housing. A control means is located adjacent the nozzle means to control fluid flow of such predetermined amount of fluid suctioned into the jet housing and fluid flow of such predetermined amount of fluid expelled from the jet housing. An expulsion means is located adjacent the control means to expel such predetermined amount of fluid from the jet housing back into such hydrotherapeutic receptacle. A power source is connected to the expulsion means to enable the expulsion means to expel such predetermined amount of fluid from the jet housing at a predetermined pressure into such hydrotherapeutic receptacle at a predetermined rate.

OBJECTS OF THE INVENTION

It is, therefore, one of the primary objects of the present invention to provide a hydrotherapeutic whirlpool jet apparatus that eliminates the need for excessive piping to and from a motor or water pump system.

Another object of the present invention is to provide a hydrotherapeutic whirlpool jet apparatus that can operate using minimal water levels.

Still another object of the present invention is to provide a hydrotherapeutic whirlpool jet apparatus that is much easier to install than prior hydrotherapeutic whirlpool jet units.

Yet another object of the present invention is to provide a hydrotherapeutic whirlpool jet apparatus that can be easily disassembled for cleaning and servicing.

An even further object of the present invention is to provide a hydrotherapeutic whirlpool jet apparatus that is cost effective over whirlpool jet units being used now.

In addition to the above described objects and advantages of the present invention, various other objects and advantages of the hydrotherapeutic whirlpool jet apparatus will become more readily apparent to those persons skilled in such art from the more detailed description, particularly, when such description is taken in conjunction with the attached drawing figures and with the appended claims.

DETAILED DESCRIPTION OF THE PREFERRED EMBODIMENTS OF THE INVENTION

Figure 1:
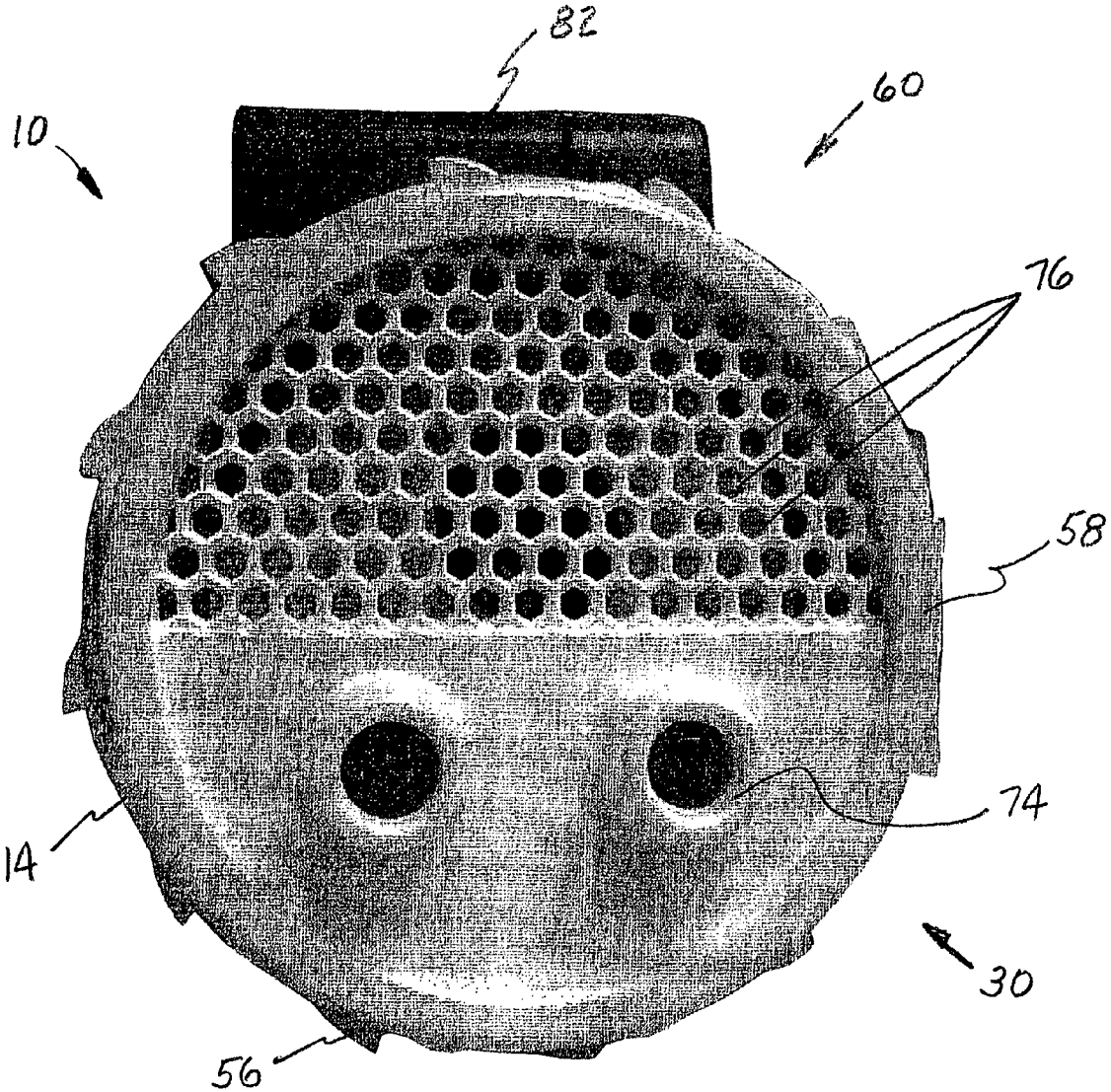
FIG. 1 is a front elevation view of a hydrotherapeutic whirlpool jet apparatus of the present invention.

Prior to proceeding to the more detailed description of the invention, it should be noted that, for the sake of clarity, identical components, having identical functions have been identified with identical reference numerals throughout the several drawing figures.

Figure 2:
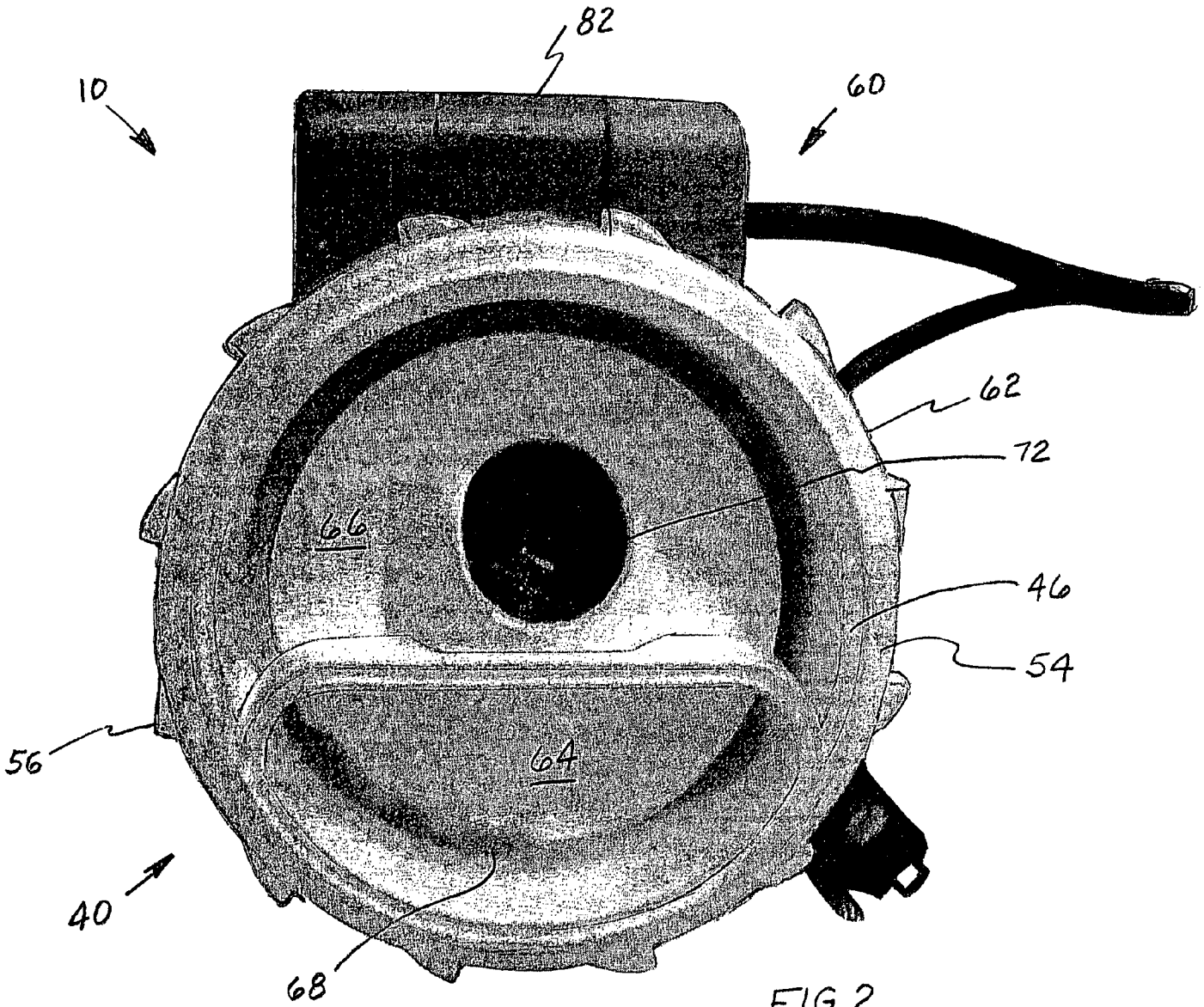
FIG. 2 is a front elevation view of a hydrotherapeutic whirlpool jet apparatus, as illustrated in FIG. 1, with the nozzle means removed to show the inner configuration of the control means.
Figure 3:
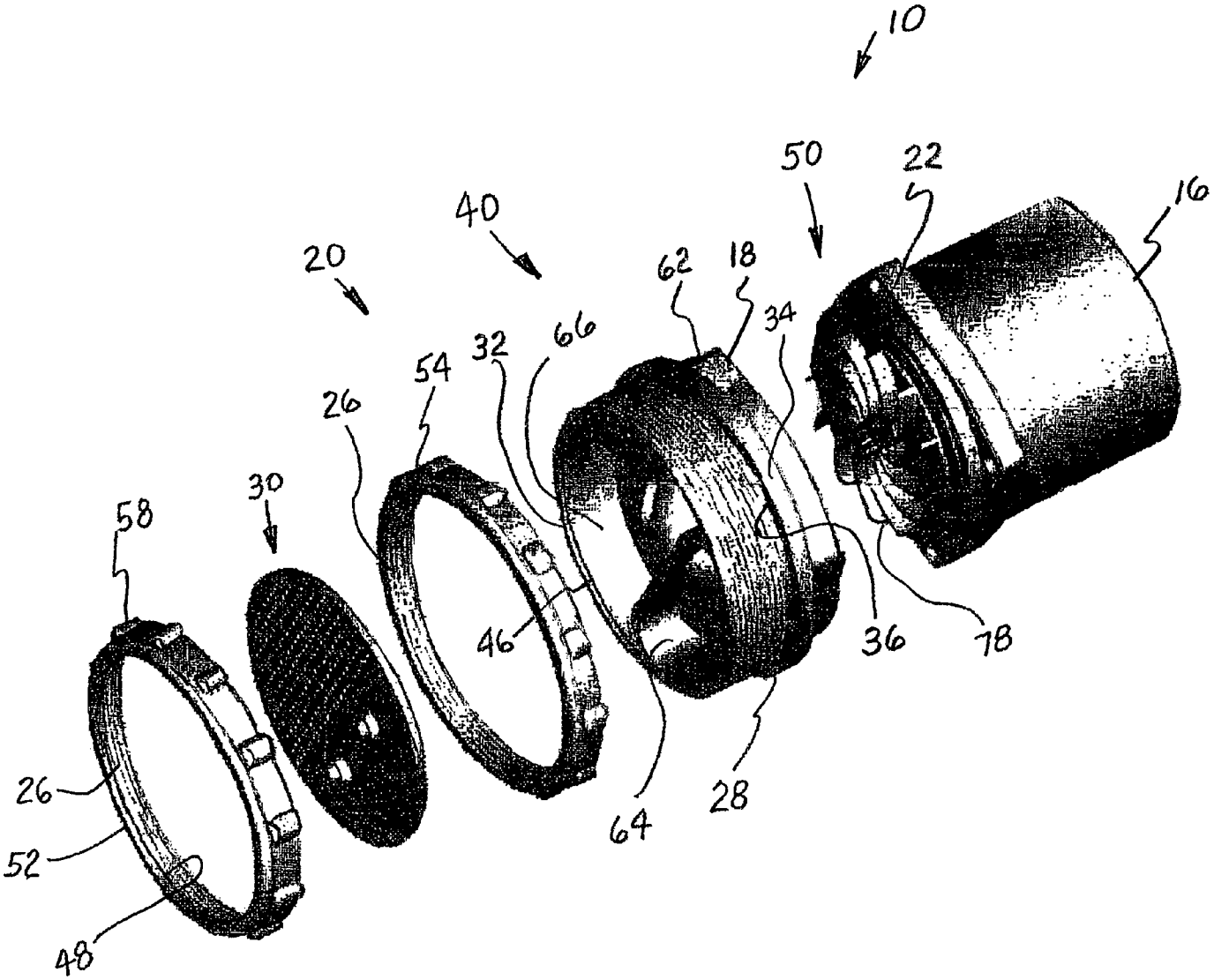
FIG. 3 is an exploded view of a hydrotherapeutic whirlpool jet apparatus.
Figure 4:
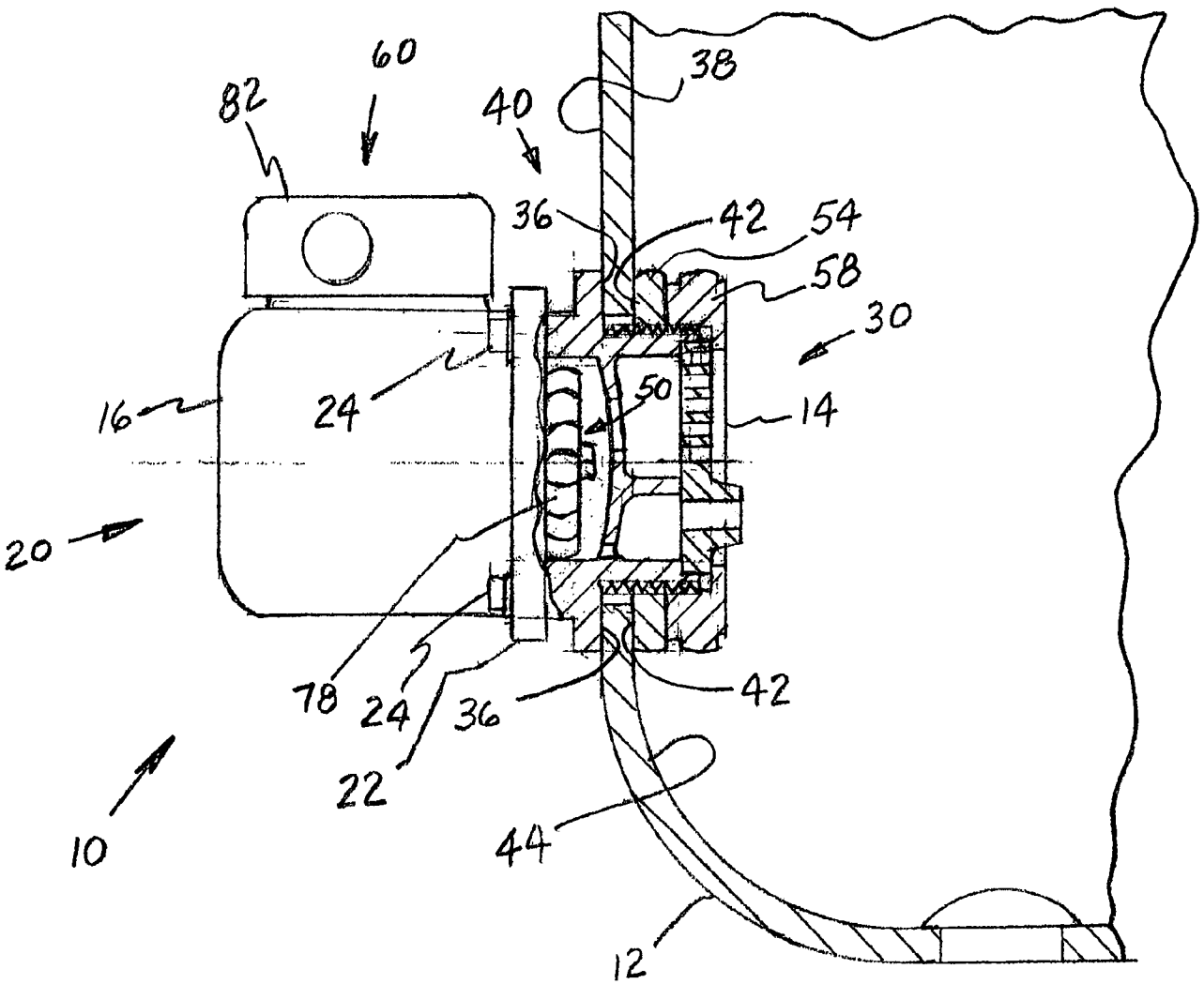
FIG. 4 is a side elevation view, partially in cross-section, showing a hydrotherapeutic whirlpool jet apparatus installed in a hydrotherapeutic receptacle.

Referring now, more particularly, to FIGS. 1-4 of the drawings, there is illustrated an apparatus, generally designated 10, for re-circulating a fluid contained within a hydrotherapeutic receptacle 12, such as a whirlpool, a spa, a hot tub or a bathtub, without the need for piping to either of a motor or a water pump system. The apparatus 10 includes at least one jet housing, generally designated 20, having a portion thereof engageable with the hydrotherapeutic receptacle 12. The jet housing 20 has a first end 14 and a second end 16.

The apparatus 10 also includes a nozzle means, generally designated 30, located at the first end 14 of the jet housing 20 that provides an entrance for a predetermined amount of fluid to be suctioned into the jet housing 20 and an exit for a predetermined amount of suctioned fluid to be expelled from the jet housing 20. In addition, a control means, generally designated 40, is located adjacent the nozzle means 30 to control the fluid flow of such predetermined amount of fluid suctioned into the jet housing 20 and the fluid flow of such predetermined amount of fluid expelled from the jet housing 20.

The apparatus 10 further includes an expulsion means, generally designated 50, located adjacent the control means 40 for expelling such predetermined amount of fluid from the jet housing 20 back into such hydrotherapeutic receptacle 12. Finally, a power source, generally designated 60, is connected to the expulsion means 50 to provide power thereto which enables the expulsion means 50 to expel such predetermined amount of fluid from the jet housing 20 at a predetermined pressure into such hydrotherapeutic receptacle 12 at a predetermined rate.

In a presently preferred embodiment of apparatus 10, the nozzle means 30 and the control means 40 of the jet housing 20 are detachable from such jet housing 20, which shall be explained in further detail below, for either cleaning or servicing of the apparatus 10. Also, the nozzle means 30 and the control means 40 can be constructed from either plastic, metal, ceramic or various combinations thereof. Preferably, both the nozzle means 30 and the control means 40 are constructed from plastic.

The control means 40 has a first end 18 that can be bolted to an outwardly extending flange member 22 around an exterior circumference of the jet housing 20 using bolts 24. Also, the nozzle means 30 includes at least one retaining ring member that is located at the first end 14 of the jet housing 20 for retaining the nozzle means 30 adjacent the control means 40.

The retaining ring member has an interior threaded portion 26 for threadedly engaging a threaded portion 28 around an exterior circumference of said control means 40 beginning at a second end 32 of the control means 40 and terminating at an outwardly extending flange member 34 located intermediate the exterior circumference of the control means 40.

The portion of the jet housing 20 that is engageable with such hydrotherapeutic receptacle 12 is a substantially flat surface portion 36 of the outwardly extending flange member 34 located intermediate the exterior circumference of the control means 40 that abuts an exterior wall surface 38 of such hydrotherapeutic receptacle 12 and a substantially flat surface portion 42 of the retaining ring member abutting an interior wall surface 44 of such hydrotherapeutic receptacle 12.

The nozzle means 30 is retained between an inwardly extending ledge portion 46 around an inner circumference adjacent the second end 32 of the control means 40 and an inwardly extending ledge portion 48 around an inner circumference adjacent an outer edge 52 of the retaining ring member.

In another presently preferred embodiment of the apparatus 10, the retaining ring member will be a split ring member having a first portion 54 and a second portion 58 and, also, will include knurls 56 to aid in gripping for either threading the retaining ring member onto the control means 40 or threading the retaining ring member off of the control means 40.

In still another presently preferred embodiment of the apparatus 10, the control means 40 includes a dual manifold 62 having an intake portion 64 for fluid flow of such predetermined amount of fluid being suctioned into the jet housing 20 and an output portion 66 for fluid flow of such predetermined amount of fluid being expelled from the jet housing 20. The intake portion 64 of the dual manifold 62 has at least one channel 68 to funnel such predetermined amount of fluid being suctioned into the jet housing 20 to the output portion 66 of the dual manifold 62, the output portion 66 having an aperture 72 where such predetermined pressure from the expulsion means 50 forces such predetermined amount of fluid back into such hydrotherapeutic receptacle 12.

The nozzle means 30 further includes a predetermined number of apertures 74 located adjacent the intake portion 64 of the dual manifold 62 to provide such predetermined amount of fluid into the jet housing 20 and a predetermined number of apertures 76 located adjacent the output portion 66 of the dual manifold 62 to provide such predetermined direction of such predetermined amount of fluid to be expelled from the jet housing 20. In addition, the predetermined number of apertures 76 of the nozzle means 30 located adjacent the output portion 66 will be sufficient to expel fluid in multiple directions.

The expulsion means 50 uses a blade rake propeller 78 to expel such predetermined amount of fluid within the jet housing 20 back into such hydrotherapeutic receptacle 12. The power source 60 connected to the expulsion means 50 is located adjacent the second end 16 of the jet housing 20. The power source 60 can be any one of an ac electric motor, a dc electric motor, a battery or a generator. Preferably, the power source 60 used is an ac electric motor 82.

While the presently preferred embodiments of the invention has been discussed in considerable detail above, it should be obvious to those persons who are skilled in the art that various modifications and adaptations of the present invention can be made without departing from the spirit of the invention and the scope of the appended claims.

I claim:

1. An apparatus for re-circulating a fluid contained within one of a whirlpool, a spa, a hot tub and a bathtub without a need for piping to one of a motor and a water pump system, said apparatus comprising:

(a) at least one jet housing having a portion thereof engageable with such one of such whirlpool, spa, hot tub and bathtub;

(b) a nozzle means located at one end of said at least one jet housing for providing entry of a predetermined amount of fluid suctioned into said at least one jet housing and exit of a predetermined amount of suctioned fluid expelled from said at least one jet housing, said nozzle means includes at least one retaining ring member located at said one end of said at least one jet housing for retaining said nozzle means adjacent a control means, said at least one retaining ring member includes an interior threaded portion for threadedly engaging a threaded portion around an exterior circumference of said control means beginning at a second end of said control means and terminating at an outwardly extending flange member located intermediate said exterior circumference of said control means;

(c) said control means located adjacent said nozzle means for controlling fluid flow of such predetermined amount of fluid suctioned into said at least one jet housing and fluid flow of such predetermined amount of fluid expelled from said at least one jet housing;

(d) an expulsion means located adjacent said control means for expelling such predetermined amount of fluid from said at least one jet housing back into such one of such whirlpool, spa, hot tub and bathtub; and e) a power source connected to said expulsion means for enabling said expulsion means to expel such predetermined amount of fluid from said at least one jet housing at a predetermined pressure into such one of such whirlpool, spa, hot tub and bathtub at a predetermined rate.

2. An apparatus, according to claim 1, wherein said nozzle means and said control means of said at least one jet housing are detachable from said at least one jet housing for one of cleaning and servicing of said apparatus.

3. An apparatus, according to claim 1, wherein said nozzle means is constructed from one of plastic, metal, ceramic and various combinations thereof.

4. An apparatus, according to claim 3, wherein said nozzle means is constructed from said plastic.

5. An apparatus, according to claim 1, wherein said control means is constructed from one of plastic, metal, ceramic and various combinations thereof.

6. An apparatus, according to claim 5, wherein said control means is constructed from said plastic.

7. An apparatus, according to claim 1, wherein said control means includes a first end bolted to an outwardly extending flange member around an exterior circumference of said at least one jet housing.

8. An apparatus, according to claim 1, wherein said portion of said at least one jet housing engageable with such one of such whirlpool, spa, hot tub and bathtub includes a substantially flat surface portion of said outwardly extending flange member located intermediate said exterior circumference of said control means abutting an exterior wall surface of such one of such whirlpool, spa, hot tub and bathtub and a substantially flat surface portion of said at least one retaining ring member abutting an interior wall surface of such one of such whirlpool, spa, hot tub and bathtub.

9. An apparatus, according to claim 1, wherein said nozzle means is retained between an inwardly extending ledge portion around an inner circumference adjacent a second end of said control means and an inwardly extending ledge portion around an inner circumference adjacent an outer edge of said at least one retaining ring member.

10. An apparatus, according to claim 1, wherein said at least one retaining ring member is a split ring member.

11. An apparatus, according to claim 1, wherein said at least one retaining ring member includes knurls for gripping said at least one retaining ring member when wanting to one of thread onto said control means and thread off of said control means.

12. An apparatus, according to claim 1, wherein said expulsion means includes a blade rake propeller.

13. An apparatus, according to claim 1, wherein said control means includes a dual manifold having an intake portion for fluid flow of such predetermined amount of fluid being suctioned into said at least one jet housing and an output portion for fluid flow of such predetermined amount of fluid being expelled from said at least one jet housing.

14. An apparatus, according to claim 13, wherein said intake portion of said dual manifold includes at least one channel for funneling such predetermined amount of fluid being suctioned into said at least one jet housing to said output portion of said dual manifold, said output portion including an aperture where such predetermined pressure from said expulsion means forces such predetermined amount of fluid back into such one of such whirlpool, spa, hot tub and bathtub.

15. An apparatus, according to claim 14, wherein said nozzle means includes a predetermined number of apertures located adjacent said intake portion of said dual manifold for providing such predetermined amount of fluid into said at least one jet housing and a predetermined number of apertures located adjacent said output portion of said dual manifold for providing such predetermined direction of such predetermined amount of fluid to be expelled from said at least one jet housing.

16. An apparatus, according to claim 15, wherein said predetermined number of apertures of said nozzle means located adjacent said output portion are sufficient to expel fluid in multiple directions.

17. An apparatus, according to claim 1, wherein said power source connected to said expulsion means includes one of an ac electric motor, a dc electric motor, a battery and a generator.

18. An apparatus, according to claim 17, wherein said power source connected to said expulsion means is said ac electric motor.

* * * * *